US010714021B2

(12) United States Patent
Pyo et al.

(10) Patent No.: US 10,714,021 B2
(45) Date of Patent: Jul. 14, 2020

(54) VOLTAGE VALUE SETTING DEVICE AND METHOD

(71) Applicant: Samsung Display Co., Ltd., Yongin-si (KR)

(72) Inventors: Si Beak Pyo, Yongin-si (KR); Sun Joon Hwang, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/296,223

(22) Filed: Mar. 8, 2019

(65) Prior Publication Data

US 2019/0311682 A1 Oct. 10, 2019

(30) Foreign Application Priority Data

Apr. 4, 2018 (KR) ..... 10-2018-0039187

(51) Int. Cl.
*G09G 3/3291* (2016.01)
*G09G 3/3258* (2016.01)
*G09G 5/10* (2006.01)

(52) U.S. Cl.
CPC ..... *G09G 3/3291* (2013.01); *G09G 3/3258* (2013.01); *G09G 5/10* (2013.01); *G09G 2310/027* (2013.01); *G09G 2330/021* (2013.01); *G09G 2330/028* (2013.01); *G09G 2360/145* (2013.01)

(58) Field of Classification Search
CPC .... G09G 3/006; G09G 3/3233; G09G 3/3258; G09G 3/3291; G09G 5/10; G09G 2300/0819; G09G 2300/0861; G09G 2310/0216; G09G 2310/0251; G09G 2310/0262; G09G 2310/027; G09G 2320/0233; G09G 2330/021; G09G 2330/028; G09G 2330/12; G09G 2360/145
See application file for complete search history.

(56) References Cited

U.S. PATENT DOCUMENTS 70,076,695 3/2017 Hwang et al.
10,559,264 B2 * 2/2020 Yu ..... G09G 3/3233
(Continued)

FOREIGN PATENT DOCUMENTS

KR 10-0788387 12/2007
KR 10-2017-0031322 3/2017
(Continued)

*Primary Examiner* — Nelson M Rosario
(74) *Attorney, Agent, or Firm* — H.C. Park & Associates, PLC

(57) ABSTRACT

A voltage value setting device including a test control unit which provides a temporary black grayscale voltage value and a temporary transistor off voltage value to a display device, and a luminance measurement unit which measures a luminance of a black grayscale that the display device displays based on the temporary black grayscale voltage value and the temporary transistor off voltage value. When the measured luminance of the black grayscale is lower than a black luminance threshold, the test control unit provides the display device with a black grayscale voltage value, set by adding a first margin value to the temporary black grayscale voltage value, and a transistor off voltage value, set by adding a second margin value to the temporary transistor off voltage value.

13 Claims, 8 Drawing Sheets

(56) References Cited

U.S. PATENT DOCUMENTS

| | | | | |
|---|---|---|---|---|
| 2019/0080648 | A1 | 3/2019 | Hwang et al. | |
| 2019/0130825 | A1 | 5/2019 | Pyo et al. | |
| 2019/0130827 | A1 | 5/2019 | Pyo et al. | |
| 2019/0139497 | A1* | 5/2019 | Chang | G09G 3/3233 |

FOREIGN PATENT DOCUMENTS

| | | |
|---|---|---|
| KR | 10-2019-0029833 | 3/2019 |
| KR | 10-2019-0049977 | 5/2019 |
| KR | 10-2019-0049979 | 5/2019 |

* cited by examiner

| | | | | | | | | | |
|---|---|---|---|---|---|---|---|---|---|
| 5.8 | 5.9 | 6.0 | 6.1 | 6.2 | 6.3 | 6.4 | 6.5 | 6.6 | VREGt (V) |
| 6.0 | 6.1 | 6.2 | 6.3 | 6.4 | 6.5 | 6.6 | 6.7 | 6.8 | VGHt (V) |
| 6.6 | 6.7 | 6.8 | 6.9 | 7.0 | 7.1 | 7.2 | 7.3 | 7.4 | VLINt (V) |

FIG. 7

| PATTERN | VREG | VGH | VLIN | POWER FOR BLACK | REDUCTION OF POWER |
|---|---|---|---|---|---|
| | [V] | [V] | [V] | [mW] | [%] |
| BLACK | 5.8 | 6.0 | 6.6 | 224.0 | 11.7 |
| | – | – | – | – | – |
| | 6.0 | 6.2 | 6.8 | 230.9 | 9.0 |
| | 6.1 | 6.3 | 6.9 | 233.6 | 7.9 |
| | 6.2 | 6.4 | 7.0 | 237.4 | 6.4 |
| | 6.3 | 6.5 | 7.1 | 241.3 | 4.9 |
| | 6.4 | 6.6 | 7.2 | 245.5 | 3.2 |
| | 6.5 | 6.7 | 7.3 | 249.4 | 1.7 |
| | 6.6 | 6.8 | 7.4 | 253.6 | Ref |

VOLTAGE VALUE SETTING DEVICE AND METHOD

CROSS REFERENCE TO RELATED APPLICATION

This application claims priority from and the benefit of Korean Patent Application No. 10-2018-0039187, filed on Apr. 4, 2018, which is hereby incorporated by reference for all purposes as if fully set forth herein.

BACKGROUND

Field

Exemplary embodiments of the invention relate generally to a voltage value setting device and method, and, more specifically, to a voltage value setting device and method for a display device.

Discussion of the Background

With the development of information technology, the importance of a display device, which is a connecting medium between a user and information, is emphasized. Accordingly, the use of display devices, such as Liquid Crystal Display (LCD) devices, Organic Light-Emitting Display (OLED) devices, plasma display devices, and the like, is increasing.

In order to reduce manufacturing costs, a large number of display devices are simultaneously formed on a large-area mother substrate, and these display devices may be separated into individual display devices through a scribe process.

However, these individual display devices may include components having different operational features depending on the location in the mother substrate or due to another reason. Therefore, when the same voltage values are set for all of the display devices, light having a desired luminance based on a grayscale voltage may not be emitted therefrom, resulting in users possibly regarding the display device as a defective one.

In the conventional method, voltage values are set using a large margin in voltage value in order to solve the above problem, but this may result in an excessive and undesirable amount of power being consumed by individual display devices.

The above information disclosed in this Background section is only for understanding of the background of the inventive concepts, and, therefore, it may contain information that does not constitute prior art.

SUMMARY

Exemplary embodiments of the inventive concepts are directed to a voltage value setting device and method through which voltage values may be set so as to enable light having a desired luminance to be emitted depending on a grayscale voltage and so as to reduce power consumption.

Additional features of the inventive concepts will be set forth in the description which follows, and in part will be apparent from the description, or may be learned by practice of the inventive concepts.

An exemplary embodiment of the inventive concepts provide for a voltage value setting device including a test control unit configured to provide a temporary black grayscale voltage value and a temporary transistor off voltage value to a display device; and a luminance measurement unit configured to measure a luminance of a black grayscale that the display device displays based on the temporary black grayscale voltage value and the temporary transistor off voltage value. When the measured luminance of the black grayscale is lower than a black luminance threshold, the test control unit provides the display device with a black grayscale voltage value, set by adding a first margin value to the temporary black grayscale voltage value, and a transistor off voltage value, set by adding a second margin value to the temporary transistor off voltage value.

When the measured luminance is equal to or higher than the black luminance threshold, the test control unit may reset the temporary black grayscale voltage value by adding a first delta value thereto, and reset the temporary transistor off voltage value by adding a second delta value thereto.

The test control unit may further provide a temporary IC reference voltage value to the display device, the luminance measurement unit may measure the luminance of the black grayscale that the display device displays based on the temporary black grayscale voltage value, the temporary transistor off voltage value, and the temporary IC reference voltage value, and the test control unit may further provide the display device with an IC reference voltage value set by adding a third margin value to the temporary IC reference voltage value when the measured luminance is lower than the black luminance threshold.

When the measured luminance is equal to or higher than the black luminance threshold, the test control unit may reset the temporary black grayscale voltage value by adding a first delta value thereto, reset the temporary transistor off voltage value by adding a second delta value thereto, and reset the temporary IC reference voltage value by adding a third delta value thereto.

The test control unit may provide the black grayscale voltage value, the transistor off voltage value, and the IC reference voltage value to a voltage value record unit of the display device.

The voltage value record unit may be disposed in a driver-IC of the display device.

The IC reference voltage value may be a value for an IC reference voltage that is used to generate a black grayscale voltage and a transistor off voltage in the driver-IC.

The IC reference voltage may be a high voltage supplied from a DC-DC converter of the display device to the driver-IC based on the IC reference voltage value.

The black grayscale voltage value may be a value for a black grayscale voltage from among grayscale voltages outputted from the driver-IC to a data line of the display device.

The transistor off voltage value may be a value for a transistor off voltage outputted from the driver-IC to a scan driver or an emission control driver of the display device.

A pixel of the display device may include a switching transistor, and the transistor off voltage may be supplied from the scan driver to a gate electrode of the switching transistor, and the data line may be connected with one electrode of the switching transistor.

Another exemplary embodiment of the inventive concepts provide for a voltage value setting method include providing a temporary black grayscale voltage value and a temporary transistor off voltage value to a display device; measuring a luminance of a black grayscale that the display device displays based on the temporary black grayscale voltage value and the temporary transistor off voltage value; and providing a black grayscale voltage value, set by adding a first margin value to the temporary black grayscale voltage value, and a transistor off voltage value, set by adding a second margin value to the temporary transistor off voltage value, to the display device when the measured luminance of the black grayscale is lower than a black luminance threshold.

The voltage value setting method may further include, when the measured luminance is equal to or higher than the black luminance threshold, resetting the temporary black grayscale voltage value by adding a first delta value thereto and resetting the temporary transistor off voltage value by adding a second delta value thereto.

Providing the temporary black grayscale voltage value and the temporary transistor off voltage value may include further providing a temporary IC reference voltage value to the display device, measuring the luminance may be configured to measure the luminance of the black grayscale that the display device displays based on the temporary black grayscale voltage value, the temporary transistor off voltage value, and the temporary IC reference voltage value, and providing the black grayscale voltage value and the transistor off voltage value may be configured to further provide an IC reference voltage value, set by adding a third margin value to the temporary IC reference voltage value, to the display device.

The voltage value setting method may further include, when the measured luminance is equal to or higher than the black luminance threshold, resetting the temporary black grayscale voltage value by adding a first delta value thereto, resetting the temporary transistor off voltage value by adding a second delta value thereto, and resetting the temporary IC reference voltage value by adding a third delta value thereto.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

FIG. 7 is a table illustrating the effect of reducing power consumption when a voltage value setting device and a voltage value setting method according to an exemplary embodiment of the inventive concepts.

DETAILED DESCRIPTION

Figure 1:
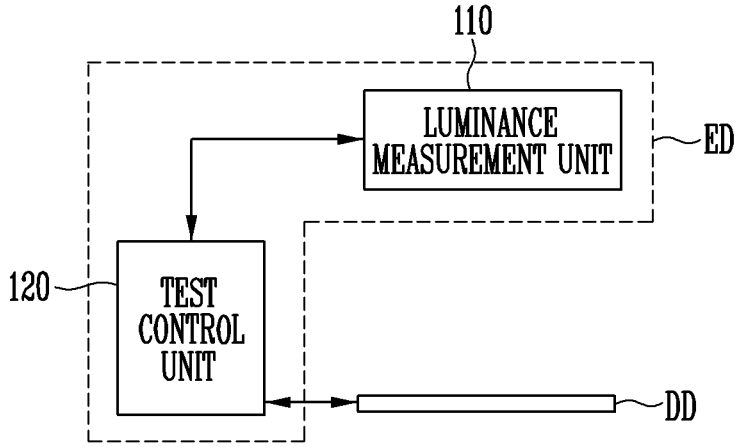
FIG. 1 is a diagram illustrating a voltage value setting device according to an exemplary embodiment of the inventive concepts.

In the following description, for the purposes of explanation, numerous specific details are set forth in order to provide a thorough understanding of various exemplary embodiments of the invention. As used herein "embodiments" are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

In the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

As is customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

In order to clearly explain the present disclosure, certain parts not relevant to the description are omitted, and like reference numerals denote like parts throughout this specification. Accordingly, previously used reference numerals may be used in different drawings.

Because the size and thickness of each configuration illustrated in the drawings are arbitrarily illustrated for better understanding and ease of description, the present disclosure is not limited thereto. In the drawings, the thickness of layers and regions may be exaggerated for clarity.

FIG. 1 is a diagram illustrating a voltage value setting device according to an exemplary embodiment of the inventive concepts.

Referring to FIG. 1, a voltage value setting device ED includes a luminance measurement unit 110 and a test control unit 120.

The test control unit 120 may provide a temporary black grayscale voltage value and a temporary transistor off voltage value to a display device DD. According to an exemplary embodiment, the test control unit 120 may further provide a temporary IC reference voltage value to the display device DD. The definitions of the temporary black grayscale voltage value, the temporary transistor off voltage value, and the temporary IC reference voltage value will be described later with reference to FIG. 2.

The test control unit 120 may be configured with a general-purpose or special-purpose computing device. The computing device may include a recording medium and a processor. The recording medium and the processor may be physically included in the same device, but may be physically included in different devices using a "cloud" method or the like.

The recording medium may be any of all types of recording media in which data or programs that can be read by the processor may be stored. Examples of the processor-readable recording medium include a ROM, a RAM, a CD-ROM, a magnetic tape, a floppy disk, an optical data storage device, a hard disk, an external hard disk, an SSD, a USB storage device, a DVD, a Blu-ray disk, and the like. Also, the processor-readable recording medium may be a combination of multiple devices, or may be distributed across computer systems connected over a network. Such a recording medium may be a non-transitory computer-readable medium. The non-transitory computer-readable medium may be a processor-readable medium for semi-permanently storing data or programs therein, rather than for temporarily storing data or programs therein, such as a register, a cache, a memory, or the like.

The luminance measurement unit 110 may measure the luminance of a black grayscale that the display device DD displays based on the temporary black grayscale voltage value and the temporary transistor off voltage value. According to an exemplary embodiment, the luminance measurement unit 110 may measure the luminance of a black grayscale that the display device DD displays based on the temporary black grayscale voltage value, the temporary transistor off voltage value, and the temporary IC reference voltage value. The luminance measurement unit 110 may be configured with a device such as a camera, an optical sensor, or the like.

When the measured luminance is equal to or higher than a black luminance threshold, the test control unit 120 may reset the temporary black grayscale voltage value by adding a first delta value thereto and reset the temporary transistor off voltage value by adding a second delta value thereto. According to an exemplary embodiment, the test control unit 120 may reset the temporary IC reference voltage value by adding a third delta value thereto.

That is, because the temporary voltage values currently provided to the display device DD are determined to be not adequate to display a black grayscale, the test control unit 120 may provide the reset temporary voltage values to the display device DD again.

When the luminance measured for the black grayscale is lower than the black luminance threshold, the test control unit 120 may provide the display device DD with a black grayscale voltage value, which is set by adding a first margin value to the temporary black grayscale voltage value, and a transistor off voltage value, which is set by adding a second margin value to the temporary transistor off voltage value. According to an exemplary embodiment, when the measured luminance is lower than the black luminance threshold, the test control unit 120 may further provide an IC reference voltage value, which is set by adding a third margin value to the temporary IC reference voltage value, to the display device DD.

That is, because the temporary voltage values that are currently provided to the display device DD are determined to be adequate to display a black grayscale, the test control unit 120 may provide the display device DD with the final voltage values that are set by adding suitable margin values to the currently provided temporary voltage values. Here, the test control unit 120 may provide the black grayscale voltage value, the transistor off voltage value, and the IC reference voltage value to the voltage value record unit of the display device DD.

The voltage value record unit and the definitions of the black grayscale voltage value, the transistor off voltage value, and the IC reference voltage value will be described below with reference to FIG. 2.

Figure 2:
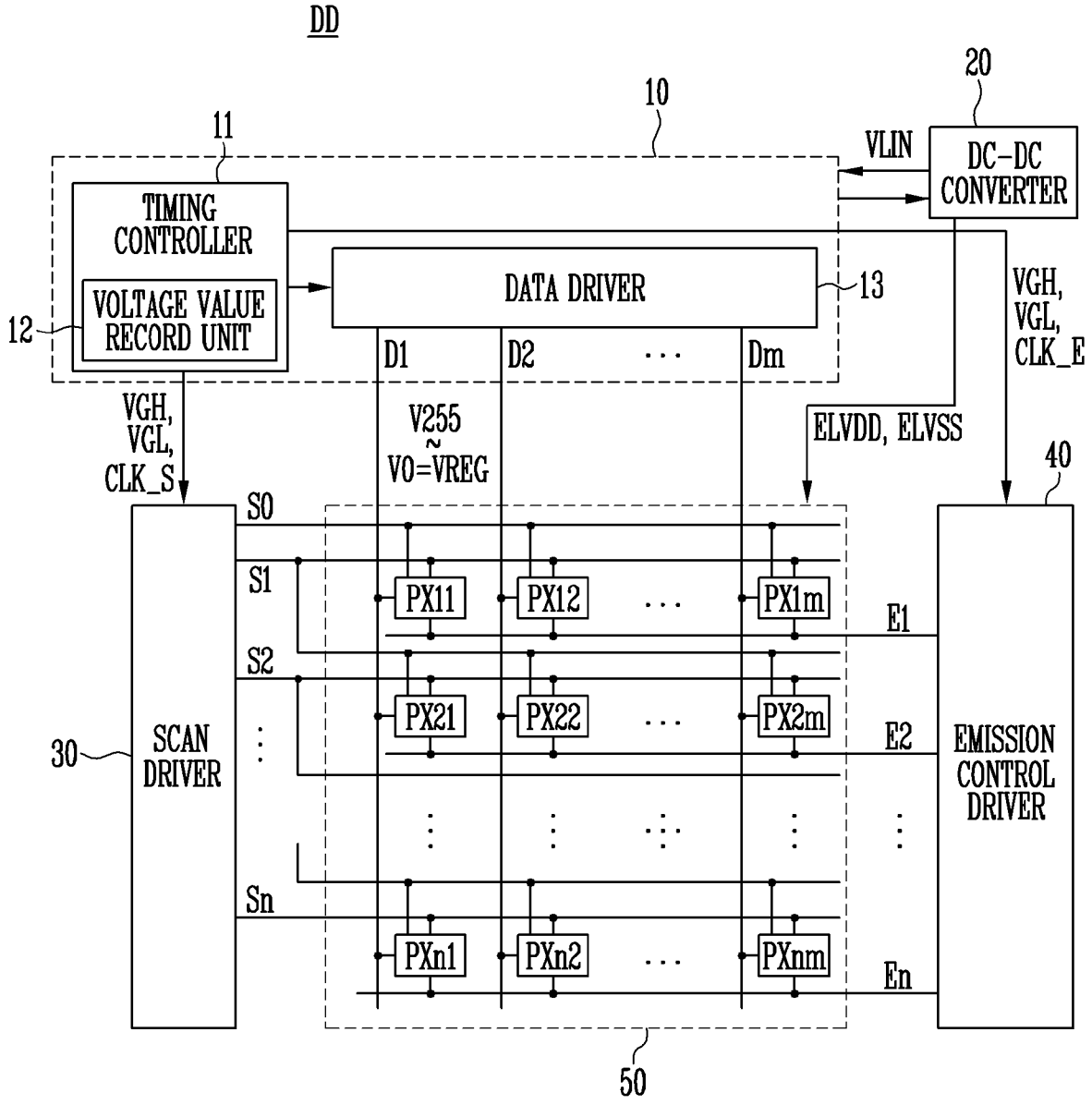
FIG. 2 is a diagram illustrating a display device according to an exemplary embodiment of the inventive concepts.

FIG. 2 is a diagram illustrating a display device according to an exemplary embodiment of the inventive concepts.

Referring to FIG. 2, a display device DD may include a driver-IC 10, a DC-DC converter 20, a scan driver 30, an emission control driver 40, and a pixel unit 50.

The driver-IC 10 may include a timing controller 11 and a data driver 13. When multiple data drivers are required depending on the product, multiple driver-ICs include the data drivers, respectively, and the timing controller may be separate therefrom in order to control the multiple driver-ICs. Hereinafter, the case in which the timing controller 11 and the data driver 13 are included in a single driver-IC 10 will be described.

Also, the driver-IC 10 may include a voltage value record unit 12. The voltage value record unit 12 may be a recording medium, such as a register or the like. The voltage value record unit 12 may record a black grayscale voltage value corresponding to a black grayscale voltage VREG, a transistor off voltage value corresponding to a transistor off voltage VGH, a transistor on voltage value corresponding to a transistor on voltage VGL, an IC reference voltage value corresponding to an IC reference voltage VLIN, and the like.

In FIG. 2, the voltage value record unit 12 is illustrated as being included in the timing controller 11, but depending on the product, the voltage value record unit 12 may be disposed in another region of the driver-IC 10, rather than in the timing controller 11.

The driver-IC 10 may generate a black grayscale voltage VREG and a transistor off voltage VGH based on the black grayscale voltage value and the transistor off voltage value provided from the voltage value record unit 12.

The black grayscale voltage VREG may be a grayscale voltage V0 for a black grayscale, among grayscale voltages V0 to V255 outputted from the driver-IC 10 to the data lines D1 to Dm of the display device DD. The remaining grayscale voltages V1 to V255 may be voltages generated by dividing the black grayscale voltage VREG. However, the remaining grayscale voltages V1 to V255 may vary depending on the nit mode. The number of grayscale voltages V0 to V255 may vary depending on the product.

The transistor off voltage VGH may be outputted from the driver-IC 10 to the scan driver 30 or the emission control driver 40. The transistor off voltage VGH may be applied to scan lines S0 to Sn or emission control lines E1 to En for a certain period under the control of the scan driver 30 or the emission control driver 40. The timing at which the transistor off voltage VGH is applied will be described later with reference to FIG. 4.

The DC-DC converter 20 may generate a first power voltage to be applied to a first power voltage line ELVDD and a second power voltage to be applied to a second power voltage line ELVSS. The first power voltage and the second power voltage may be used to generate a driving current of an organic light-emitting diode (OLED) by being supplied to the pixel unit 50. Also, the DC-DC converter 20 may generate an IC reference voltage VLIN based on the IC reference voltage value provided from the voltage value record unit 12 and provide the IC reference voltage VLIN to the driver-IC 10. The IC reference voltage VLIN may be a high voltage that is used when the driver-IC 10 generates the black grayscale voltage VREG, the transistor off voltage VGH, and the transistor on voltage VGL.

Because it is difficult for the driver-IC 10 to generate a high voltage required for representation of grayscales only using the driving voltage supplied thereto, the DC-DC converter 20 for generating a high voltage may be configured in the form of a power management integrated circuit (PMIC), and then be included in the display device DD.

The timing controller 11 may convert a control signal and an image signal supplied from a processor (for example, an application processor) so as to be suitable for the specifications of the display device DD, and may supply the control signal and the image signal to the data driver 13, the scan driver 30, and the emission control driver 40.

The data driver 13 may generate grayscale voltages V0 to V255 to be supplied to the data lines D1 to Dm by receiving the control signal and the image signal from the timing controller 11. The grayscale voltages generated for each pixel row may be simultaneously applied to the data lines D1 to Dm.

The scan driver 30 may generate scan signals to be applied to the scan lines S0 to Sn by receiving a control signal CLK_S, the transistor off voltage VGH, and the transistor on voltage VGL from the timing controller 11. The control signal CLK_S may be at least one clock signal. The scan driver 30 may have scan stage circuits corresponding to the respective scan lines S0 to Sn. The respective scan stage circuits are connected in the form of shift registers, whereby the output of one scan stage circuit may be generated based on the output of the previous scan stage circuit. Each of the scan stage circuits may output a scan signal in which the control signal CLK_S and the transistor off voltage VGH are combined. In another exemplary embodiment, the scan stage circuits may output a scan signal in which the transistor on voltage VGL and the transistor off voltage VGH are combined.

The emission control driver 40 may generate emission control signals to be supplied to the emission control lines E1 to En by receiving a control signal CLK_E, the transistor off voltage VGH, and the transistor on voltage VGL from the timing controller 11. The control signal CLK_E may be at least one clock signal. The emission control driver 40 may have emission control stage circuits corresponding to the respective emission control lines E1 to En. The respective emission control stage circuits are connected in the form of shift registers, whereby the output of one emission control stage circuit may be generated based on the output of the previous emission control stage circuit. Each of the emission control stage circuits may output an emission control signal in which the transistor on voltage VGL and the transistor off voltage VGH are combined.

The pixel unit 50 may include pixels PX11 to PXnm. Each of the pixels may be connected with a corresponding one of the data lines, a corresponding one of the scan lines, and a corresponding one of the emission control lines. For each of the pixels, whether to input a grayscale voltage thereto is determined depending on the scan signal, and an emission start time and an emission end time may be determined depending on the emission control signal.

Figure 3:
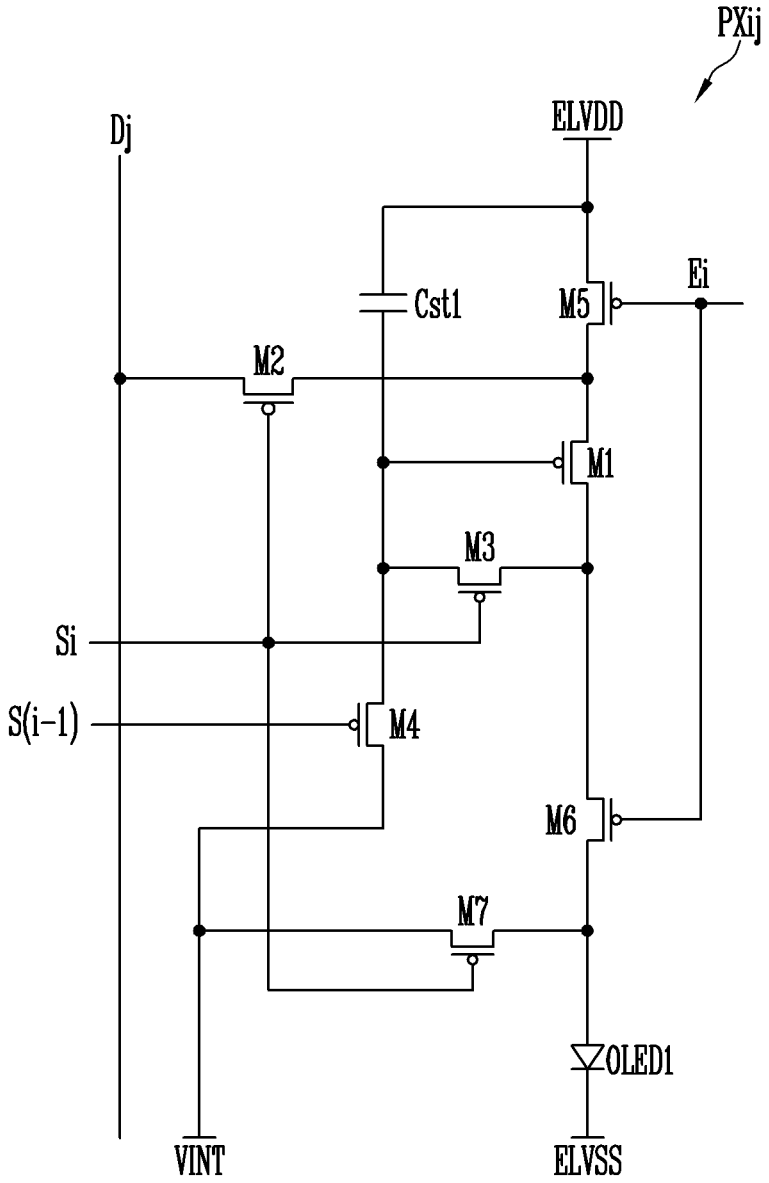
FIG. 3 is a schematic diagram illustrating a pixel according to an exemplary embodiment of the inventive concepts.

FIG. 3 is a schematic diagram illustrating a pixel according to an exemplary embodiment of the inventive concepts.

Referring to FIG. 3, a pixel PXij includes transistors M1, M2, M3, M4, M5, M6 and M7, a storage capacitor Cst1, and an organic light-emitting diode OLED1.

The storage capacitor Cst1 may be configured such that the first electrode thereof is connected with a first power voltage line ELVDD and the second electrode thereof is connected with the gate electrode of the transistor M1.

The first electrode of the transistor M1 is connected with the second electrode of the transistor M5, the second electrode of the transistor M1 is connected with the first electrode of the transistor M6, and the gate electrode of the transistor M1 is connected with the second electrode of the storage capacitor Cst1. The transistor M1 may be referred to as a "driving" transistor. The transistor M1 determines the amount of the driving current flowing between the first power voltage line ELVDD and the second power voltage line ELVSS depending on the potential difference between the gate electrode and the source electrode thereof.

The first electrode of the transistor M2 is connected with the data line Dj, the second electrode of the transistor M2 is connected with the first electrode of the transistor M1, and the gate electrode of the transistor M2 is connected with the current scan line Si. The transistor M2 may be referred to as a "switching" transistor. When a scan signal of a turn-on level is applied to the current scan line Si, the transistor M2 applies the grayscale voltage of the data line Dj to the pixel PXij.

The first electrode of the transistor M3 is connected with the second electrode of the transistor M1, the second electrode of the transistor M3 is connected with the gate electrode of the transistor M1, and the gate electrode of the transistor M3 is connected with the current scan line Si. When a scan signal of a turn-on level is applied to the current scan line Si, the transistor M3 connects the transistor M1 in the form of a diode.

The first electrode of the transistor M4 is connected with the gate electrode of the transistor M1, the second electrode of the transistor M4 is connected with the initialization voltage line VINT, and the gate electrode of the transistor M4 is connected with the previous scan line S(i−1). In another exemplary embodiment, the gate electrode of the transistor M4 may be connected with another scan line. When a scan signal of a turn-on level is applied to the previous scan line S(i−1), the transistor M4 delivers the initialization voltage VINT to the gate electrode of the transistor M1, thereby initializing the electric charge amount at the gate electrode of the transistor M1.

The first electrode of the transistor M5 is connected with the first power voltage line ELVDD, the second electrode of the transistor M5 is connected with the first electrode of the transistor M1, and the gate electrode of the of the transistor M5 is connected with the emission control line Ei.

The first electrode of the transistor M6 is connected with the second electrode of the transistor M1, the second electrode of the transistor M6 is connected with the anode of the organic light-emitting diode OLED1, and the gate electrode of the transistor M6 is connected with the emission control line Ei. The transistors M5 and M6 may be referred to as "emission control" transistors. When an emission control signal of a turn-on level is applied to the transistors M5 and M6, the transistors M5 and M6 generate a driving current path between the first power voltage line ELVDD and the second power voltage line ELVSS, thereby causing the organic light-emitting diode OLED1 emit light.

The first electrode of the transistor M7 is connected with the anode of the organic light-emitting diode OLED1, the second electrode of the transistor M7 is connected with the initialization voltage line VINT, and the gate electrode of the transistor M7 is connected with the current scan line Si. In another exemplary embodiment, the gate electrode of the transistor M7 may be connected with another scan line. When a scan signal of a turn-on level is applied to the current scan line Si, the transistor M7 delivers the initialization voltage VINT to the anode of the organic light-emitting diode OLED1, thereby initializing the amount of electric charge deposited in the organic light-emitting diode OLED1.

The anode of the organic light-emitting diode OLED1 is connected with the second electrode of the transistor M6 and the cathode of the organic light-emitting diode OLED1 is connected with the second power voltage line ELVSS.

Figure 4:
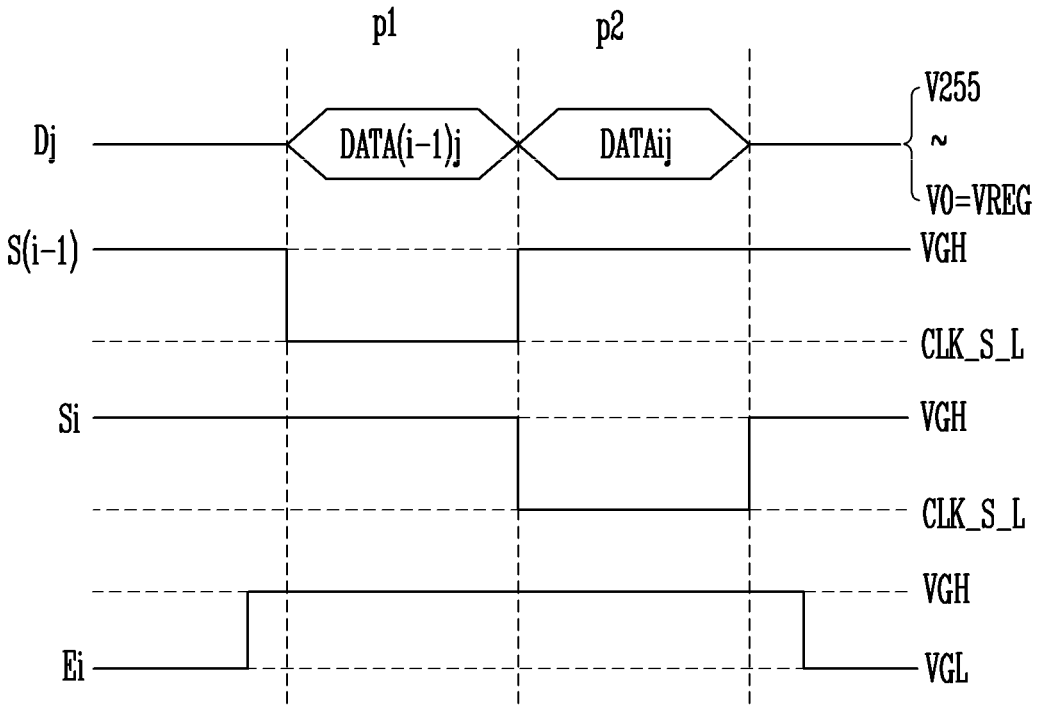
FIG. 4 is a timing diagram illustrating an exemplary method for operating the pixel illustrated in FIG. 3.

FIG. 4 is a timing diagram illustrating an exemplary method for operating the pixel illustrated in FIG. 3.

In the period p1, a grayscale voltage DATA(i−1)j for the previous pixel row is applied to the data line Dj, and a scan signal of a turn-on level (low level) is applied to the previous scan line S(i−1). The scan signal of the turn-on level may be a voltage CLK_S_L corresponding to the low level of the above-described control signal CLK_S.

Because a scan signal of a turn-off level (high level) is applied to the current scan line Si, the transistor M2 becomes a turn-off state, and the grayscale voltage DATA(i−1)j for the previous pixel row is prevented from being applied to the pixel PXij. Here, the scan signal of the turn-off level may be the transistor off voltage VGH.

Because the transistor M4 is in a turn-on state, an initialization voltage is applied to the gate electrode of the transistor M1, whereby the electric charge amount at the gate electrode of the transistor M1 is initialized. Because an emission control signal of a turn-off level is applied to the emission control line Ei, the transistors M5 and M6 become a turn-off state, whereby unnecessary light emission by the organic light-emitting diode OLED1, which may be caused by the process of applying the initialization voltage VINT, is prevented. Here, the emission control signal of the turn-off level may be the transistor off voltage VGH.

In the period p2, a grayscale voltage DATAij for the current pixel row is applied to the data line Dj, and a scan signal of a turn-on level is applied to the current scan line Si. Accordingly, the transistors M2, M1 and M3 become conductive, and the data line Dj and the gate electrode of the transistor M1 are electrically connected with each other. Accordingly, the data voltage DATAij is applied to the second electrode of the storage capacitor Cst1, and electric charge corresponding to the difference between the voltage of the first power voltage line ELVDD and the grayscale voltage DATAij is deposited in the storage capacitor Cst1.

Because the transistor M7 is in a turn-on state, the initialization voltage VINT is applied to the anode of the organic light-emitting diode OLED1, whereby the organic light-emitting diode OLED1 is pre-charged or initialized with the electric charge amount corresponding to the difference between the initialization voltage and the voltage of the second power voltage line ELVSS.

After the period p2, an emission control signal of a turn-on level is applied to the emission control line Ei, whereby the transistors M5 and M6 become conductive. Also, the amount of the driving current passing through the transistor M1 is adjusted depending on the amount of electric charge deposited in the storage capacity Cst1, whereby the driving current flows to the organic light-emitting diode OLED1. The organic light-emitting diode OLED1 continues to emit light until an emission control signal of a turn-off level is applied to the emission control line Ei. Here, the emission control signal of the turn-on level may be the transistor on voltage VGL.

Figure 5:
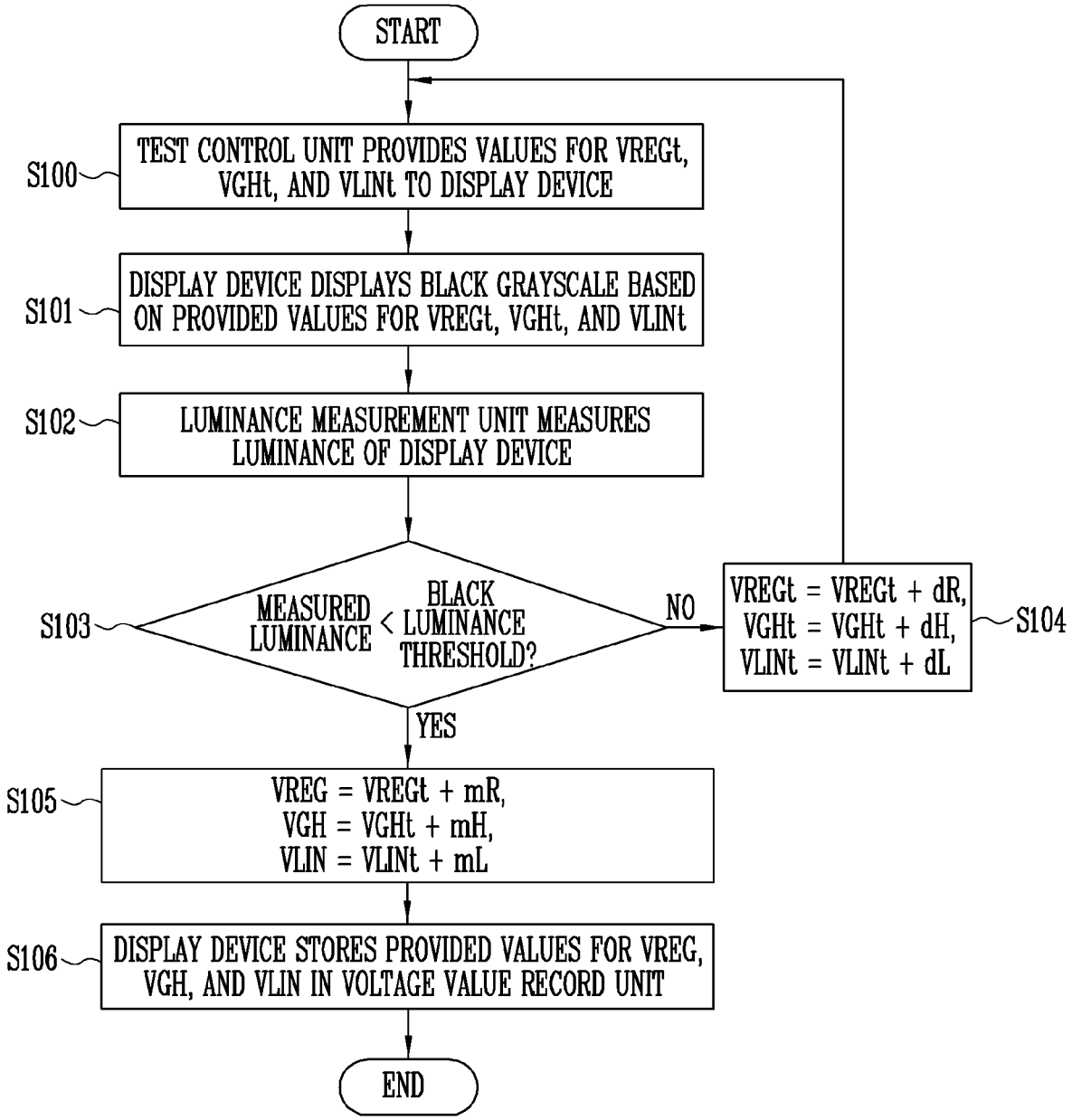
FIG. 5 is a flow chart illustrating a voltage value setting method according to an exemplary embodiment of the inventive concepts.
Figure 6:
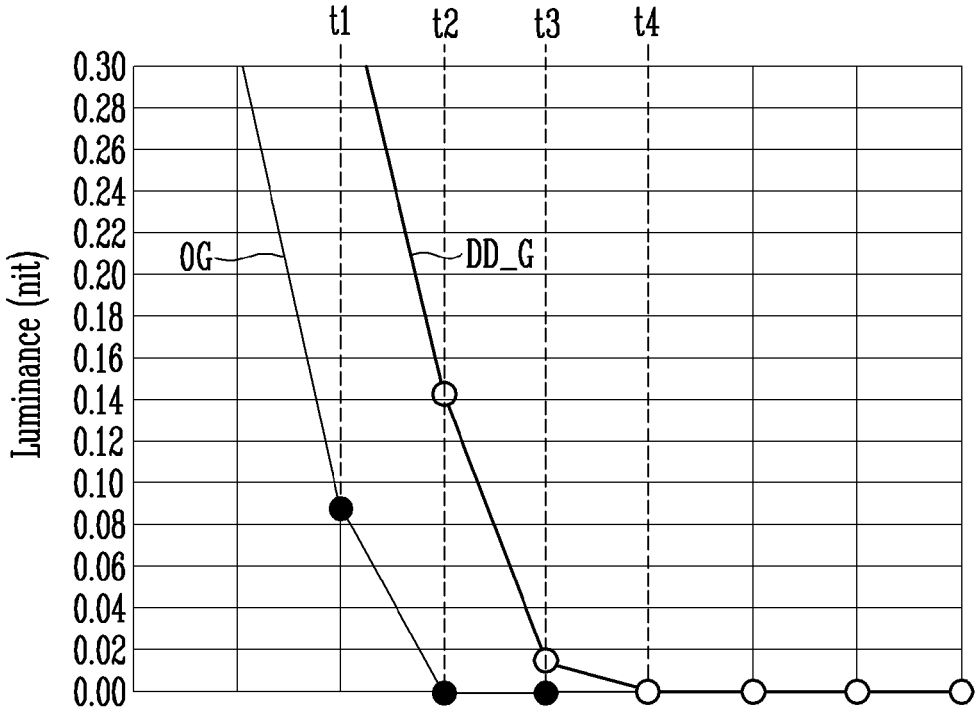
FIG. 6 is a diagram illustrating some steps of the voltage value setting method of FIG. 5 through examples.

FIG. 5 is a flow chart illustrating a voltage value setting method according to an embodiment, and FIG. 6 is a diagram illustrating some steps of the voltage value setting method in FIG. 5 through examples.

FIG. 6 illustrates exemplary graphs OG and DD_G for two respective display devices, but a description is provided below with reference to the graph DD_G of the display device DD.

First, the test control unit 120 may provide values for a temporary black grayscale voltage VREGt, a temporary transistor off voltage VGHt, and a temporary IC reference voltage VLINt to the display device DD at step S100 shown in FIG. 5.

The display device DD may generate the temporary black grayscale voltage VREGt, the temporary transistor off voltage VGHt, and the temporary IC reference voltage VLINt using the provided voltage values, and may display a black grayscale at step S101.

Then, the luminance measurement unit 110 may measure the luminance of a black grayscale displayed by the display device DD at step S102.

For example, assuming that the current time corresponds to the time point t2 in FIG. 6, the temporary black grayscale voltage VREGt, the temporary transistor off voltage VGHt, and the temporary IC reference voltage VLINt may be 6.1V, 6.3V, and 6.9V, respectively. Here, the measured luminance may be 0.14 nit.

The test control unit 120 may determine at step S103 whether the measured luminance is lower than a preset black luminance threshold. The black luminance threshold may be set to a different value depending on the product, and may be set depending on whether the value thereof may be accepted as a black grayscale in the corresponding product. Hereinafter, the black luminance threshold is assumed to be 0.01 nit.

Because the measured luminance of 0.14 nit is higher than the black luminance threshold, the test control unit 120 may reset the value of the temporary black grayscale voltage VREGt by adding a first delta value dR thereto, reset the value of the temporary transistor off voltage VGHt by adding a second delta value dH thereto, and reset the value of the temporary IC reference voltage VLINt by adding a third delta value dL thereto at step S104. For example, the first to third delta values dR, dH, and dL may be set to about 0.1 V.

The voltage value setting device ED again performs the above-described steps S100, S101 and S102. Then, when the luminance measured at the time point t3 is 0.02 nit, the condition of the step S103 is still not satisfied. Accordingly, the steps S104, S100, S101 and S102 are performed again.

Then, when the luminance measured at the time point t4 in FIG. 6 is equal to or lower than 0.01 nit, the condition of the step S103 is satisfied. Here, referring to FIG. 6, the temporary black grayscale voltage VREGt, the temporary transistor off voltage VGHt, and the temporary IC reference voltage VLINt may be 6.3V, 6.5V, and 7.1V, respectively.

Accordingly, when the measured luminance for a black grayscale is less than the black luminance threshold, the test control unit 120 provides the display device DD with the value of the black grayscale voltage VREG, which is set by adding a first margin value mR to the value of the temporary black grayscale voltage VREGt, the value of the transistor off voltage VGH, which is set by adding a second margin value mH to the value of the temporary transistor off voltage VGHt, and the value of the IC reference voltage VLIN, which is set by adding a third margin value mL to the value of the temporary IC reference voltage VLINt, at step S105.

For example, the first to third margin values mR, mH and mL may be set to a voltage value that ranges from about 0.1 to 0.3V.

The display device DD may store the value of the black grayscale voltage VREG, the value of the transistor off voltage VGH, and the value of the IC reference voltage VLIN, which are provided thereto, in the voltage value record unit 12 at step S106.

FIG. 7 is a table illustrating the effect of reducing power consumption based on a voltage value setting device and a voltage value setting method according to an exemplary embodiment of the inventive concepts.

Referring to FIG. 7, when the black grayscale voltage VREG, the transistor off voltage VGH, and the IC reference voltage VLIN are set to 5.8V, 6.0V, and 6.6V, respectively, the maximum 11.7% reduction of power consumption may be achieved, compared to when the black grayscale voltage VREG, the transistor off voltage VGH, and the IC reference voltage VLIN are 6.6V, 6.8V, and 7.4V.

Accordingly, through the voltage value setting device and the voltage value setting method according to the inventive concepts, voltage values may be set so as to enable light with a desired luminance to be emitted based on grayscale voltages, and so as to reduce power consumption.

Figure 8:
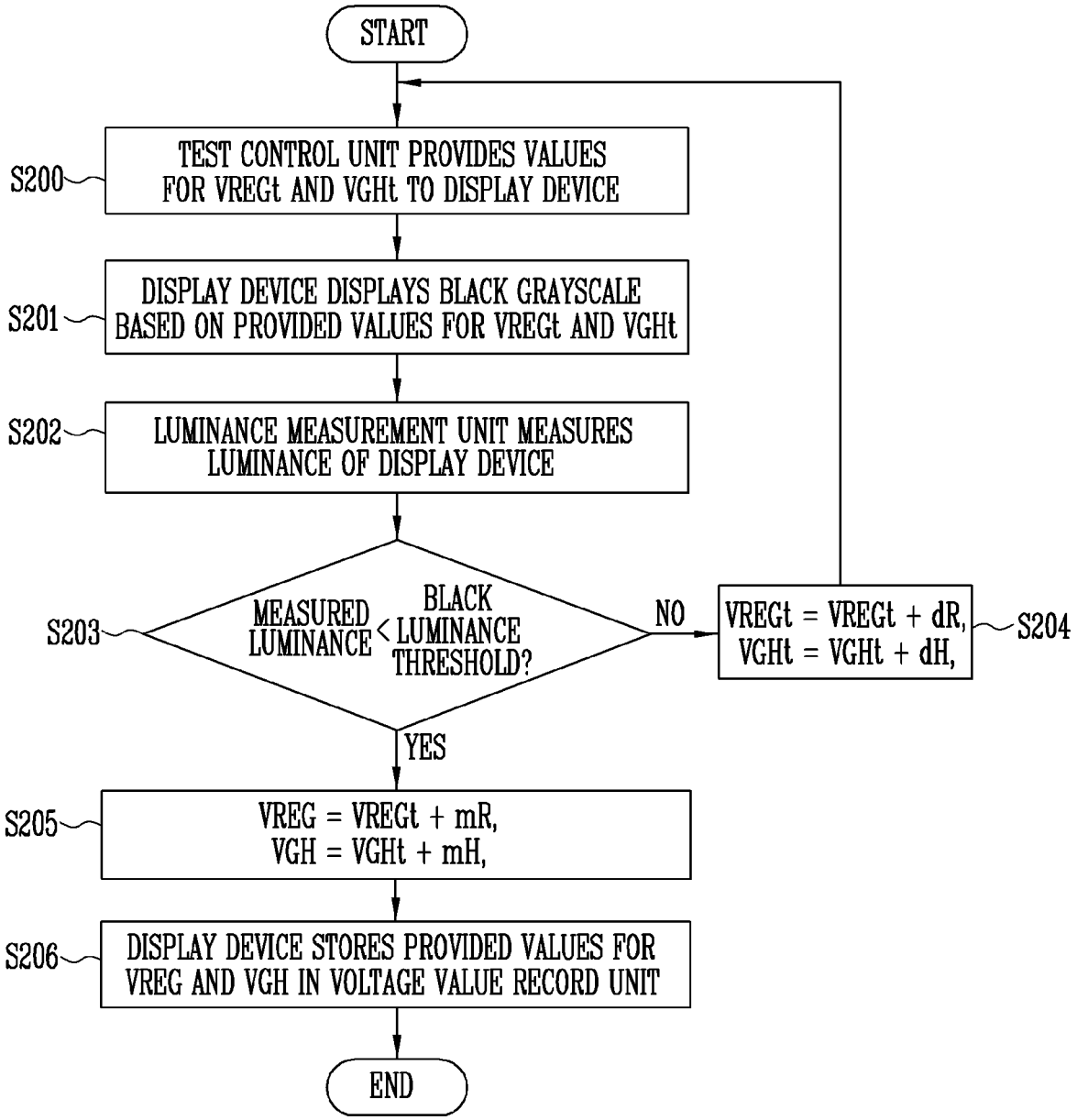
FIG. 8 is a flow chart illustrating a voltage value setting method according to another exemplary embodiment of the inventive concepts.

FIG. 8 is a flow chart illustrating a voltage value setting method according to another exemplary embodiment of the inventive concepts.

Because steps S200, S201, S202, S203, S204, S205 and S206 in FIG. 8 correspond to steps S100, S101, S102, S103, S104, S105 and S106 in FIG. 6, respectively, a repeated description will be omitted.

However, the process of setting a temporary IC reference voltage VLIN is not included in the exemplary embodiment in FIG. 8. In the exemplary embodiment illustrated in FIG. 8, the value of the temporary IC reference voltage VLIN may be a fixed value. For example, the temporary IC reference voltage VLIN may have a fixed value that may be stably provided to all display panels, rather than to an individual display panel.

According to the exemplary embodiment illustrated in FIG. 8, the effect of reducing power consumption may be decreased, but it is advantageous in that the stable operation of a display panel may be insured.

Through the voltage value setting device and the voltage value setting method according to the present disclosure, voltage values may be set such that light having a desired luminance may be emitted depending on a grayscale voltage and that power consumption may be reduced.

Although certain exemplary embodiments have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A voltage value setting device, comprising: a test control unit configured to provide a temporary black grayscale voltage value and a temporary transistor off voltage value to a display device; and a luminance measurement unit configured to measure a luminance of a black grayscale that the display device displays based on the temporary black grayscale voltage value and the temporary transistor off voltage value, wherein, when the measured luminance of the black grayscale is lower than a black luminance threshold, the test control unit provides the display device with a black grayscale voltage value, set by adding a first margin value to the temporary black grayscale voltage value, and a transistor off voltage value, set by adding a second margin value to the temporary transistor off voltage value; and wherein, when the measured luminance is equal to or higher than the black luminance threshold, the test control unit resets the temporary black grayscale voltage value by adding a first delta value thereto and resets the temporary transistor off voltage value by adding a second delta value thereto.

2. The voltage value setting device according to claim 1, wherein: the test control unit is configured to further provide a temporary IC reference voltage value to the display device; the luminance measurement unit is configured to measure the luminance of the black grayscale that the display device displays based on the temporary black grayscale voltage value, the temporary transistor off voltage value, and the temporary IC reference voltage value; and the test control unit is configured to further provide the display device with an IC reference voltage value set by adding a third margin value to the temporary IC reference voltage value when the measured luminance is lower than the black luminance threshold.

3. The voltage value setting device according to claim 2, wherein, when the measured luminance is equal to or higher than the black luminance threshold, the test control unit resets the temporary black grayscale voltage value by adding a first delta value thereto, resets the temporary transistor off voltage value by adding a second delta value thereto, and resets the temporary IC reference voltage value by adding a third delta value thereto.

4. The voltage value setting device according to claim 2, wherein the test control unit provides the black grayscale voltage value, the transistor off voltage value, and the IC reference voltage value to a voltage value record unit of the display device.

5. The voltage value setting device according to claim 4, wherein the voltage value record unit is disposed in a driver-IC of the display device.

6. The voltage value setting device according to claim 5, wherein the IC reference voltage value is a value for an IC reference voltage that is used to generate a black grayscale voltage and a transistor off voltage in the driver-IC.

7. The voltage value setting device according to claim 6, wherein the IC reference voltage is a high voltage supplied from a DC-DC converter of the display device to the driver-IC based on the IC reference voltage value.

8. The voltage value setting device according to claim 5, wherein the black grayscale voltage value is a value for a black grayscale voltage among grayscale voltages outputted from the driver-IC to a data line of the display device.

9. The voltage value setting device according to claim 8, wherein the transistor off voltage value is a value for a transistor off voltage outputted from the driver-IC to a scan driver or an emission control driver of the display device.

10. The voltage value setting device according to claim 9, wherein: the display device comprises a pixel, the pixel comprising a switching transistor; and the transistor off voltage is supplied from the scan driver to a gate electrode of the switching transistor, and the data line is connected with one electrode of the switching transistor.

11. A voltage value setting method, comprising: providing a temporary black grayscale voltage value and a temporary transistor off voltage value to a display device; measuring a luminance of a black grayscale that the display device displays based on the temporary black grayscale voltage value and the temporary transistor off voltage value; and providing a black grayscale voltage value, set by adding a first margin value to the temporary black grayscale voltage value, and a transistor off voltage value, set by adding a second margin value to the temporary transistor off voltage value, to the display device when the measured luminance of the black grayscale is lower than a black luminance threshold; and when the measured luminance is equal to or higher than the black luminance threshold, resetting the temporary black grayscale voltage value by adding a first delta value thereto and resetting the temporary transistor off voltage value by adding a second delta value thereto.

12. The voltage value setting method according to claim 11, wherein: providing the temporary black grayscale voltage value and the temporary transistor off voltage value further comprises providing a temporary IC reference voltage value to the display device, measuring the luminance is configured to measure the luminance of the black grayscale that the display device displays based on the temporary black grayscale voltage value, the temporary transistor off voltage value, and the temporary IC reference voltage value, and providing the black grayscale voltage value and the transistor off voltage value further comprises providing an IC reference voltage value, set by adding a third margin value to the temporary IC reference voltage value, to the display device.

13. The voltage value setting method according to claim 12, further comprising: when the measured luminance is equal to or higher than the black luminance threshold, resetting the temporary black grayscale voltage value by adding a first delta value thereto, resetting the temporary transistor off voltage value by adding a second delta value thereto, and resetting the temporary IC reference voltage value by adding a third delta value thereto.

* * * * *